US007661349B1

(12) United States Patent
Brittingham

(10) Patent No.: US 7,661,349 B1
(45) Date of Patent: Feb. 16, 2010

(54) MULTIFUNCTIONAL FIREARM MUZZLE ATTACHMENT SYSTEM PRIMARILY FOR ATTACHING A NOISE SUPPRESSOR TO A FIREARM

(75) Inventor: Kevin Tyson Brittingham, Norcross, GA (US)

(73) Assignee: Advanced Armament Corp., LLC, Madison, NC (US)

( * ) Notice: Subject to any disclaimer, the term of this patent is extended or adjusted under 35 U.S.C. 154(b) by 107 days.

(21) Appl. No.: 11/591,026

(22) Filed: Nov. 1, 2006

(51) Int. Cl.
*F41A 21/00* (2006.01)
*F41A 3/78* (2006.01)

(52) U.S. Cl. ..... 89/14.4; 89/14.2; 89/14.3; 89/198; 42/1.06; 42/79; 181/223

(58) Field of Classification Search ..... 89/14.2, 89/14.3, 14.4, 198; 42/1.06, 79; 181/223
See application file for complete search history.

(56) References Cited

U.S. PATENT DOCUMENTS 5,092,223 A * 3/1992 Hudson ..... 89/14.2
5,356,183 A * 10/1994 Cole ..... 285/305
5,596,161 A * 1/1997 Sommers ..... 89/14.2
5,773,746 A * 6/1998 Vaden ..... 89/14.4
D415,812 S * 10/1999 Andrews et al. ..... D22/108
6,385,891 B1 * 5/2002 Rabatin ..... 42/79
6,412,389 B2 * 7/2002 Fluhr ..... 89/14.4
6,837,139 B2 * 1/2005 Meyers ..... 89/14.2
6,948,415 B2 9/2005 Matthews et al.
7,302,774 B2 * 12/2007 Meyers ..... 42/77
D577,409 S * 9/2008 Brittingham ..... D22/108
D577,410 S * 9/2008 Brittingham ..... D22/108
2006/0060076 A1 * 3/2006 Dueck et al. ..... 89/14.4
2007/0137084 A1 * 6/2007 Laney et al. ..... 42/51
2008/0156183 A1 * 7/2008 Brittingham ..... 89/14.4

* cited by examiner

*Primary Examiner*—Bret Hayes
*Assistant Examiner*—Michael D David
(74) *Attorney, Agent, or Firm*—Greenebaum Doll & McDonald PLLC; Glenn D. Bellamy

(57) ABSTRACT

An apparatus and method for easily, quickly and reliably attaching a noise suppressor or other auxiliary device to the muzzle end of a firearm barrel and for easily, quickly and reliably removing the noise suppressor or other auxiliary device there from. My invention also provides for adjusting the host firearms point of impact by changing the orientation of the noise suppressor in relation to the host firearms bore.

9 Claims, 2 Drawing Sheets

MULTIFUNCTIONAL FIREARM MUZZLE ATTACHMENT SYSTEM PRIMARILY FOR ATTACHING A NOISE SUPPRESSOR TO A FIREARM

BACKGROUND OF THE INVENTION

1. Field of Invention

This invention generally relates to firearms, specifically to systems for quickly removing or attaching a noise suppressor or other device to the muzzle of a firearm barrel with the potential of affecting the point of impact of said firearms discharged projectile.

2. Prior Art

Previous systems exist for attaching noise suppressors to a firearm, and specifically for removing or attaching a noise suppressor to a flash suppressor affixed to the muzzle of a firearm. Systems such as the one presented in U.S. Pat. No. 6,948,415 to Surefire, LLC (2005) fall short in several areas such as ease of removal, and single hand removal. There is a need for a secure attachment system for mounting noise suppressors to a firearm particularly a flash suppressor which will withstand the vibrations incidental to firing an automatic rifle or other small arm, provide for an opportunity to single handedly remove the noise suppressor from the host firearm and to allow for multi point indexing of the noise suppressor so as to affect the point of impact of the rifles discharged projectiles.

OBJECTS AND ADVANTAGES

Accordingly several objects and advantages of the present invention are (a) to provide the user of the noise suppressor the capability of adjusting the host firearms point of impact by using an alternative thread start on the noise suppressor (b) to provide an external latch which allows for single hand attachment or removal of a noise suppressor (c) to provide a serrated surface for the external latch to contact with and eliminate unintentional rotation of the attached noise suppressor due to vibrations resulting from the discharge of a firearm.

(d) to provide multiple thread starts which will allow the noise suppressor to be oriented on the firearm in different positions so that when the host firearm is discharge the impact position of the bullet may be relocated by adjusting the position of the noise suppressor and its orientation to the host firearm.

Still further objects and advantages will become apparent from a consideration of the ensuing description and drawings.

SUMMARY

The present invention provides an apparatus and method for easily, quickly and reliably attaching a noise suppressor or other auxiliary device to the muzzle end of a firearm barrel, and for easily and quickly removing such device there from with one hand. The present invention also allows for the multi indexing or orientation of the noise suppressor in relation to the muzzle of the firearm and/or a correctly installed flash suppressor. In a preferred embodiment of the invention, a noise suppressor is removably secured to a fixture such as a flash suppressor, with five thread starts, which is secured to the muzzle end of a firearm.

In general terms, the invention provides auxiliary apparatus for attachment to a firearm including a barrel having a longitudinal axis, comprising the combination of: a fixture adapted to be attached to the muzzle of the barrel coaxially there with annular multi start threads internally coaxial to said bore, with external acme multi start threads coaxial to auxiliary device and including a serrated locking surface; and an auxiliary device having a bore for coaxially receiving the fixture with internal acme multi start threads, such device including a serrated retaining latch, and a mating surface More specifically, a preferred embodiment according to the invention provides a noise suppressor apparatus for attachment to a firearm including a barrel having a longitudinal axis, comprising the combination of: a flash suppressor adapted to be attached to the muzzle of the barrel coaxially there with and including an external annular serrated locking surface, internal multi-start threads, and five external multi start acme threads located above the annular serrated surface; and a noise suppressor including a back section having a bore for coaxially receiving the flash suppressor, the back section including five multi-start acme mating threads, and a spring loaded locking latch having serrated teeth to engage the annular serrated surface on the outside of the flash suppressor.

In a preferred embodiment of the method, the external annular serrated locking surface, five external acme multi start threads, and internal multi-start threads is provided on the barrel by providing a flash suppressor with an external annular serrated locking surface, five external acme multi start threads, and internal multi-start threads by coaxially affixing the flash suppressor to the muzzle of the barrel, and the auxiliary device comprises a noise suppressor.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
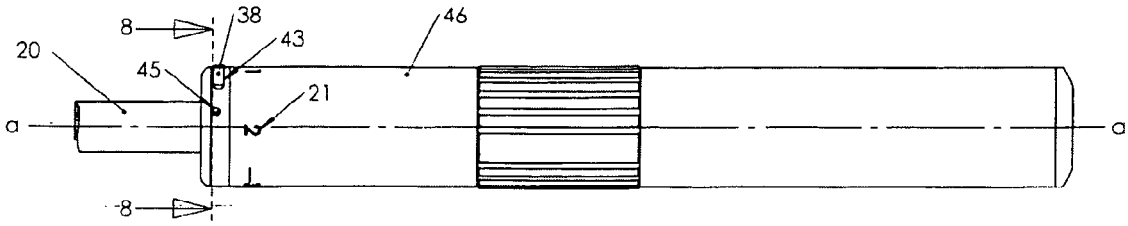
FIG. 1 shows an external side view of a noise suppressor with the proposed retaining latch location.
Figure 2:
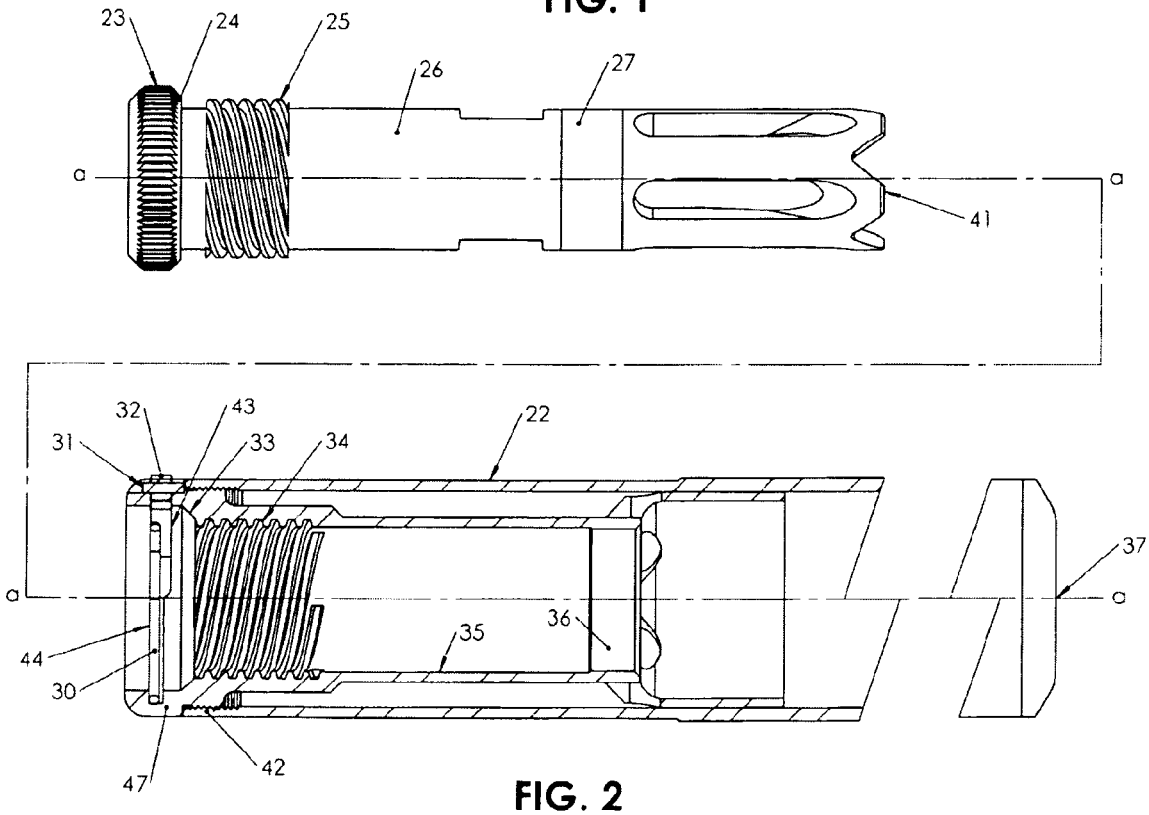
FIG. 2 shows the rear section of the flash suppressor mated to the noise suppressor with an exploded view of the preferred embodiment of the flash suppressor.
Figure 3:
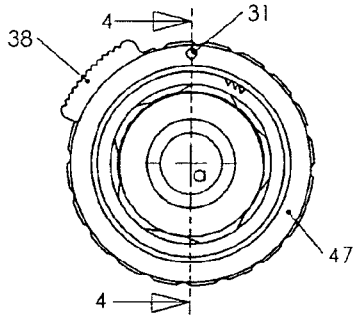
FIG. 3 is a rear view of the retaining latch and mount which is present on the noise suppressor in FIG. 1.
Figure 4:
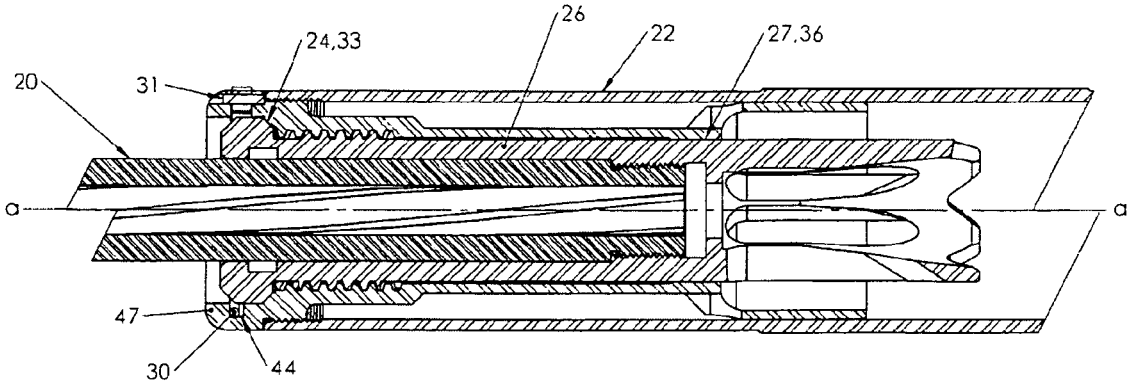
FIG. 4 shows a side view of a host firearms barrel, mounted with a flash suppressor, and noise suppressor.
Figure 5:
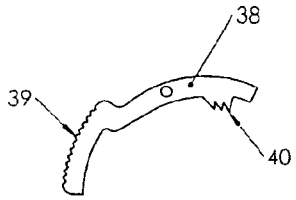
FIG. 5 shows a side view of the retaining latch for the noise suppressor.

Starting with FIG. 1, there is an illustration of an example noise suppressor 46, the line a represents the "longitudinal" axis or direction along or parallel to the longitudinal axis a of the barrel 20 of the firearm or of the flash suppressor 26 or of the noise suppressor body 22 aperture to which the flash suppressor 26 of FIG. 2 must concentrically align to in order to ensure the proper concentric, coaxial placement of the host weapon's barrel 20 in FIG. 4, in relation to the noise suppressor 46. This alignment of the aperture a prevents bullets discharged from the host firearm from striking the noise suppressor 46.

Figure 7:
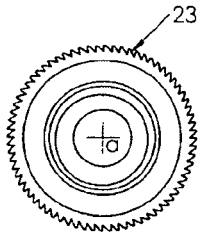
FIG. 7 shows a rear view of the serrated annular ring around the flash suppressor which is shown in FIG. 2.
Figure 6:
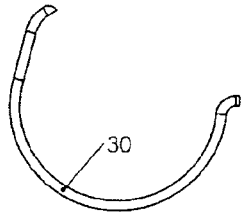
FIG. 6 shows a spring for the latch in FIG. 5.

In FIGS. 1-6, there is illustrated in FIG. 1 an example of a firearm barrel 20, to which a firearm accessory, in particular a noise suppressor according to the present invention, may be removably secured. The firearm barrel 20 having a longitudinal axis a along which a fired bullet is caused to travel. A generally tubular fixture such as a flash suppressor 26, muzzle brake or muzzle compensator is secured to the firearm barrel's 20 muzzle along the longitudinal axis a, the tubular fixture 26 having a forward opening 41 through which the fired bullet exits. The tubular fixture shown in FIGS. 2, 6 and 7 is a flash suppressor 26 which is fixedly secured to the firearm barrel 20 such as by welding or other conventional securement means (for example, by means of mating threads externally about the barrel muzzle and internally of the flash suppressor together with a high temperature cement or a locking device for preventing rotation of the installed flash suppressor 26 with respect to the firearm barrel 20. In the FIGS. 2, 3 and 7 the firearm barrel 20, to which the flash suppressor 26 is secured, is not shown for purposes of clarity of description.

In the preferred embodiment according to the present invention, the flash suppressor 26 is provided with rear bearing surface 24 which is located proximate the proximal end, although the rear bearing surface 24 may be included as a part of the exterior surface of the firearm barrel 20. The flash suppressor 26 further includes an external annular multi-start thread 25 where five thread leads are present on the preferred embodiment, although the external annular multi-start thread 25 may be included as a part of the exterior surface of the firearm barrel 20. The flash suppressor 26 at the proximal end includes an annular locking surface 23 which consist of fifty evenly space angled teeth, although the external annular locking surface 23 may be included as a part of the exterior surface of the firearm barrel 20.

As used herein, the word "front" or "forward" corresponds to the firing direction of the firearm (i.e., to the right as shown in FIGS. 1, 2, and 4); "rear" or "rearward" or "back" corresponds to the direction opposite the firing direction of the firearm (i.e., to the left as shown in FIGS. 1, 2, and 4); "longitudinal" means the direction along or parallel to the longitudinal axis a of the barrel 20 of the firearm or of the flash suppressor 26 or of the noise suppressor body 22; and "transverse" means a direction perpendicular to the longitudinal direction.

The noise suppressor body 22 includes a back section 47 having a longitudinal bore 35 for coaxially receiving the flash suppressor 26. The noise suppressor body 22 further includes a sound suppressing front section 37 fixedly secured to the back section 47 (for example by welding or threading along their circumferences where the parts meet 42) including a front end having an axial opening through which a fired bullet exits when the noise suppressor body 22 is secured to the firearm barrel 20. Noise suppressing sections of firearm noise suppressors are well known in the firearms art.

The back section 47 of the noise suppressor body 22 includes a rear window 43 perpendicular to the bore 35. The back section 47 of the noise suppressor body 22 includes an annular groove 44, concentric to the bore 35, which serves to house the locking latch spring 30.

The back section 47 of the noise suppressor body 22 includes multi start mating threads 34 on the internal bore surface 35. The exterior surface of the suppressor body 22 includes index numbers 21 engraved on the circumference, the quantity varying based on the number of multi-start threads 25 present on the flash hider 26.

A locking latch 38 having serrated teeth 40 and a pad 39 is secured in the window 43 and retained by an axial pin 31. The locking latch spring 30, resides in the annular groove 44 present about the back section 47 of the noise suppressor body 22 and spring biases the locking latch 38 toward a latched position. The spring 30 is kept in position by a radial hole 45 which anchors the proximal end of the locking latch spring 30.

When installing the noise suppressor 46 onto the firearm barrel 20, the flash suppressor 26 multi-start threads 25 are engaged with the noise suppressor's 46 multi-start threads 34. The diameter of the bore 35 is slightly greater than the outside diameter of the tubular flash suppressor 26 but is slightly less than the diameter of the rear bearing surface 24 on the flash suppressor 26.

Figure 8:
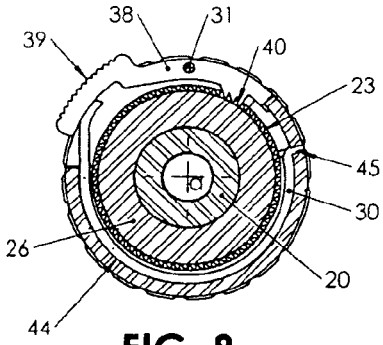
FIG. 8 shows a rear view of the latch mount of the noise suppressor engaged on the annular ring on the flash suppressor in FIG. 2.
Figure 9:
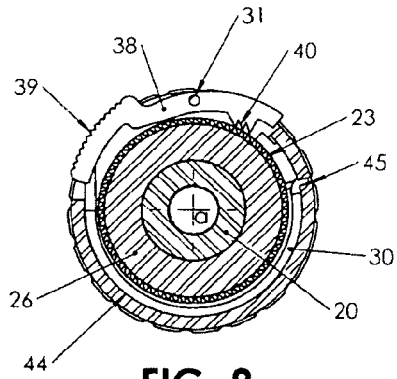
FIG. 9 shows the rear view of the latch mount of the noise suppressor disengaged from the annular ring on the flash suppressor shown in FIG. 2.

To install the noise suppressor 46 onto the firearm barrel 20, with the desired index number 21 located up, the noise suppressor body 22 is placed rearwardly onto the firearm barrel's 20 muzzle end such that the flash suppressor 26 is longitudinally received by the back section bore 35, until the front edge of the multi-stair threads 25 engages the suppressor's multi-start threads 34. The noise suppressor 46 is threadedly rotated until the rear bearing surface 24 seats against the mating surface 33 located inside of the back section 47 while simultaneously the forward bearing surface 27 engages the annular internal mating surface 36 of the noise suppressor back section 47. While the noise suppressor 46 is threadedly rotated and secured, the locking latch 38 teeth 40 ride over the annular locking surface 23. Once the mating surface 33 located at the proximal end of the noise suppressor 46 engages the rear bearing surface 24 of the flash suppressor 26, the locking latch 38 teeth 40 engage the annular locking surface 23. This motion causes the locking latch 38 to pivot radially around the axial pin 31. The locking latch teeth 40 engage the annular locking surface 23 (see FIG. 8) thus preventing the noise suppressor 46 secure from unthreading.

Upon such installation, the noise suppressor 46 is fixedly secured to the flash suppressor 26 (and hence to the barrel 20) both longitudinally and rotationally.

To remove the noise suppressor 46 from the firearm barrel 20, the locking latch pad 39 is depressed against the locking latch spring 30 where upon the locking latch teeth 40 disengage from the annular locking surface 23 while the noise suppressor 46 is rotated in the reverse or unthreading direction. The back section 47 may thereupon be forwardly longitudinally withdrawn from the flash suppressor 26 and the barrel 20 when the noise suppressor body 22 is moved longitudinally forwardly.

The noise suppressor's 46 orientation to the bore line a of the firearm barrel 20 may be adjusted into one of five positions. The multi-start thread 25 of the flash suppressor 26 and the multi-start mating threads 34 of the noise suppressor 46 number five in total thus providing five positions of orientation for the noise suppressor 46. The index numbers 21 are spaced evenly about the proximal external surface of the noise suppressor body 22.

Thus, there has been described a preferred embodiment of an apparatus for easily, quickly and reliably attaching a noise suppressor or other auxiliary device to the muzzle end of a firearm, and for easily and quickly removing the device there from, as well as a method for such attachment. Other embodiments of the present invention, and variations of the embodiment described herein, may be developed without departing from the essential characteristics thereof. Accordingly, the invention should be limited only by the scope of the claims listed below.

Accordingly the reader will see that, according to the invention, I have provided a secure retention system which will prevent a noise suppressor from backing off as a result of the vibrations incidental to the use of a firearm. Further it can be seen that my preferred embodiment of this invention with a multi start thread provides the user of a firearm equipped with a noise suppressor manufactured with my invention the ability to adjust the point of impact by changing the silencers orientation to the firearms barrel. I have also afforded any user of my invention the ability to single handedly remove or attach the noise suppressor with one hand.

While my above drawings and description contain many specificities, these should not be construed as limitations on the scope of the invention, but rather as an exemplification of one preferred embodiment thereof. For example the annular serrated surface 23 could easily be incorporated directly onto the barrel of a firearm. The latch and associated annular ring can be used with other auxiliary devices meant to be attached to the muzzle of a firearm.

Accordingly, the scope of the invention should be determined not by the embodiments illustrated, but by the appended claims and their legal equivalents.

The invention claimed is:

1. An apparatus for providing secure attachment and quick detachment of a noise suppressor to the muzzle of a firearm barrel having an axial bore, comprising:

an attachment fixture having an aperture and configured to be secured to the muzzle of a firearm barrel such that the aperture is axially aligned with the bore, said fixture having an annular abutment configured to provide a substantially forwardly facing abutment surface, an annular series of circumferentially-spaced teeth, and an external thread; and a noise suppressor having a body with a rearward end and an axial aperture therethrough, said rearward end including an opening aligned with the axial aperture and configured to receive at least a portion of said fixture, an abutment surface, an internal thread configured to engagingly mate with the fixture thread, and a lever member positioned proximate to the rearward end having a ratchet pawl and manually movable between first and second positions, said member being spring-biased for substantially radial movement of the pawl into engagement with the fixture series of teeth in the first positions, whereby, upon insertion of at least a portion of the fixture into the opening, rotation of the suppressor body relative to the fixture in a thread-engaging direction will cause the ratchet pawl to be circumferentially moved over the fixture teeth until the annular abutment of the fixture contacts the suppressor abutment surface and engagement of the pawl with the teeth prevents rotation of the suppressor body in a thread-disengaging direction upon assembly unless the lever member is manually displaced to the second position.

2. The apparatus of claim 1, wherein the fixture includes a flash suppressor.

3. The apparatus of claim 1, further comprising a radial opening in the suppressor body in which the lever member is received.

4. The apparatus of claim 3, further comprising a pivot member extending substantially parallel to the bore axis on which the lever member is mounted for pivotal movement between the first and second positions.

5. The apparatus of claim 1, further comprising an external bearing surface on the fixture and an internal bearing surface in the suppressor opening, said bearing surfaces axially spaced from the threads and configured to provide bearing engagement upon assembly of the noise suppressor with the fixture.

6. The apparatus of claim 5, further comprising an area axially between the thread and bearing surface of the fixture that is non-round.

7. The apparatus of claim 1, wherein said fixture and said noise suppressor include a plurality of threads configured to provide multiple relative starting positions for rotational engagement such that, upon assembly with abutment surfaces in contact, the noise suppressor will be situated at different rotational positions relative to the fixture depending on which of the starting positions is used.

8. The apparatus of claim 7, further comprising indicia on an exterior surface of the suppressor body indexed to correspond to each of the starting positions.

9. The apparatus of claim 1, wherein said noise suppressor is configured to extend over a portion of the barrel rearward of the muzzle when assembled in place on the fixture.

* * * * *